United States Patent [19]

Chasen

[11] Patent Number: 4,993,583

[45] Date of Patent: Feb. 19, 1991

[54] DISPLAY CONTAINER

[75] Inventor: Lee R. Chasen, Port Chester, N.Y.

[73] Assignee: Coats & Clark, Orangeburg, N.Y.

[21] Appl. No.: 338,982

[22] Filed: Apr. 14, 1989

[51] Int. Cl.[5] ..... B65D 25/24; G09F 3/18; A47F 3/101

[52] U.S. Cl. ..... 220/482; 206/362; 206/806; 40/300; 40/3.2; 211/188; 220/423; 220/659; 220/675

[58] Field of Search ..... 220/18, 23.8, 23.86, 220/72, 476, 480, 482, 670, 674, 675, 656, 659; 206/362, 363, 15.3, 15.4, 806; 248/220.3, 220.4; 211/188; 312/245; 40/308, 312

[56] References Cited

U.S. PATENT DOCUMENTS

| | | | |
|---|---|---|---|
| 1,102,284 | 7/1914 | Miller | 206/362 |
| 2,533,355 | 12/1950 | Comfort | 206/362 |
| 3,476,282 | 11/1969 | Monaco | 220/23.8 |
| 3,661,272 | 5/1972 | Fisher | 220/18 |
| 3,811,745 | 5/1974 | Cylke | 312/245 |
| 4,082,187 | 4/1978 | Carlson | 220/72 |
| 4,143,792 | 3/1979 | Rex | 220/23.86 |
| 4,160,570 | 7/1979 | Bridges | 220/18 |
| 4,213,559 | 7/1980 | Meyers | 206/806 |
| 4,376,502 | 3/1983 | Cohen | 40/308 |
| 4,473,152 | 9/1984 | Jump | 220/18 |

FOREIGN PATENT DOCUMENTS

| | | | |
|---|---|---|---|
| 1265352 | 5/1961 | France | 220/18 |
| 2272450 | 12/1975 | France | 40/312 |

*Primary Examiner*—George E. Lowrance
*Attorney, Agent, or Firm*—Burgess, Ryan & Wayne

[57] ABSTRACT

A display container includes a receptacle housing defining an enclosure therein, the receptacle housing including a front wall, rear wall, side walls and a bottom wall, the receptacle housing including an upper opening through which articles can be deposited into and removed from the enclosure; the front wall having a downwardly and inwardly extending incline so that articles deposited in the enclosure are compactly and orderly arranged therein; bump-like separators on the bottom wall and grip-like separators at the front portion of the opening for separating elongated articles deposited in the enclosure and extending from the bottom wall out of the opening; and an L-shaped securing assembly at the upper part of the rear wall for supporting the display container on a vertical slat board.

24 Claims, 8 Drawing Sheets

DISPLAY CONTAINER

BACKGROUND OF THE INVENTION

This invention relates generally to display containers and, more particularly, is related to a display container which can be mounted on a vertical wall for displaying a plurality of elongated articles therein.

When displaying elongated objects for sale, such as spatulas, basters, can openers, spoons and the like, there is a large problem of space efficiency. Specifically, such items are of different dimensions and are difficult to mount for display. In such case, the items are generally hung individually from a long hook extending from a vertical wall or are positioned in blister packs, which further increase the space that is used.

OBJECTS AND SUMMARY OF THE INVENTION

Accordingly, it is an object of the present invention to provide a display container that overcomes the aforementioned problems with the prior art.

More particularly, it is an object of the present invention to provide a display container which can display the elongated articles in a substantially vertically oriented position in a single receptacle housing.

It is another object of the present invention to provide a display container that can display such articles in the receptacle housing in an orderly manner therein.

It is still another object of the present invention to provide a display container in which the articles are separated from each other in rows in the receptacle housing.

It is yet another object of the present invention to provide a display container in which the front wall of the receptacle housing is inclined downwardly and inwardly so as to align the articles in rows in an orderly manner.

It is a further object of the present invention to provide a display container in which separator means are provided on the bottom of the receptacle housing and at the front of the receptacle housing about the upper opening thereof for separating the articles into rows.

It is a still further object of the present invention to provide a display container in which the inwardly and downwardly extending front wall presents an appearance to the consumer that the receptacle housing is always full.

It is a yet further object of the present invention to provide a display container having ribs or stiffeners along the side walls for imparting stiffness to the receptacle housing.

It is another object of the present invention to provide a display container including means connected to the upper rear wall thereof for hanging the display container from a vertical wall, which can be a peg board or slat board.

It is still another object of the present invention to provide a display container having an undercut pocket in the front wall thereof for receiving a snap-in label.

It is yet another object of the present invention to provide a display container which can be a vacuum formed plastic structure.

It is a further object of the present invention in which a plurality of display containers can be arranged in an orderly arrangement on a slat board or peg board in modular fashion.

It is a still further object of the present invention in which a plurality of vacuum formed display containers can be nested together for storage and shipping.

It is a yet further object of the present invention to provide a display container that is easy and economical to manufacture and use.

In accordance with an aspect of the present invention, a display container includes a receptacle housing defining an enclosure therein, the receptacle housing including at least a front wall and a bottom wall, and the receptacle housing including an upper opening through which articles can be deposited into and removed from the enclosure; the front wall having a downwardly and inwardly extending incline; separator means at a front portion of the opening for separating articles deposited in the enclosure; and securing means connected with the receptacle housing for securing the receptacle housing on a vertical wall.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
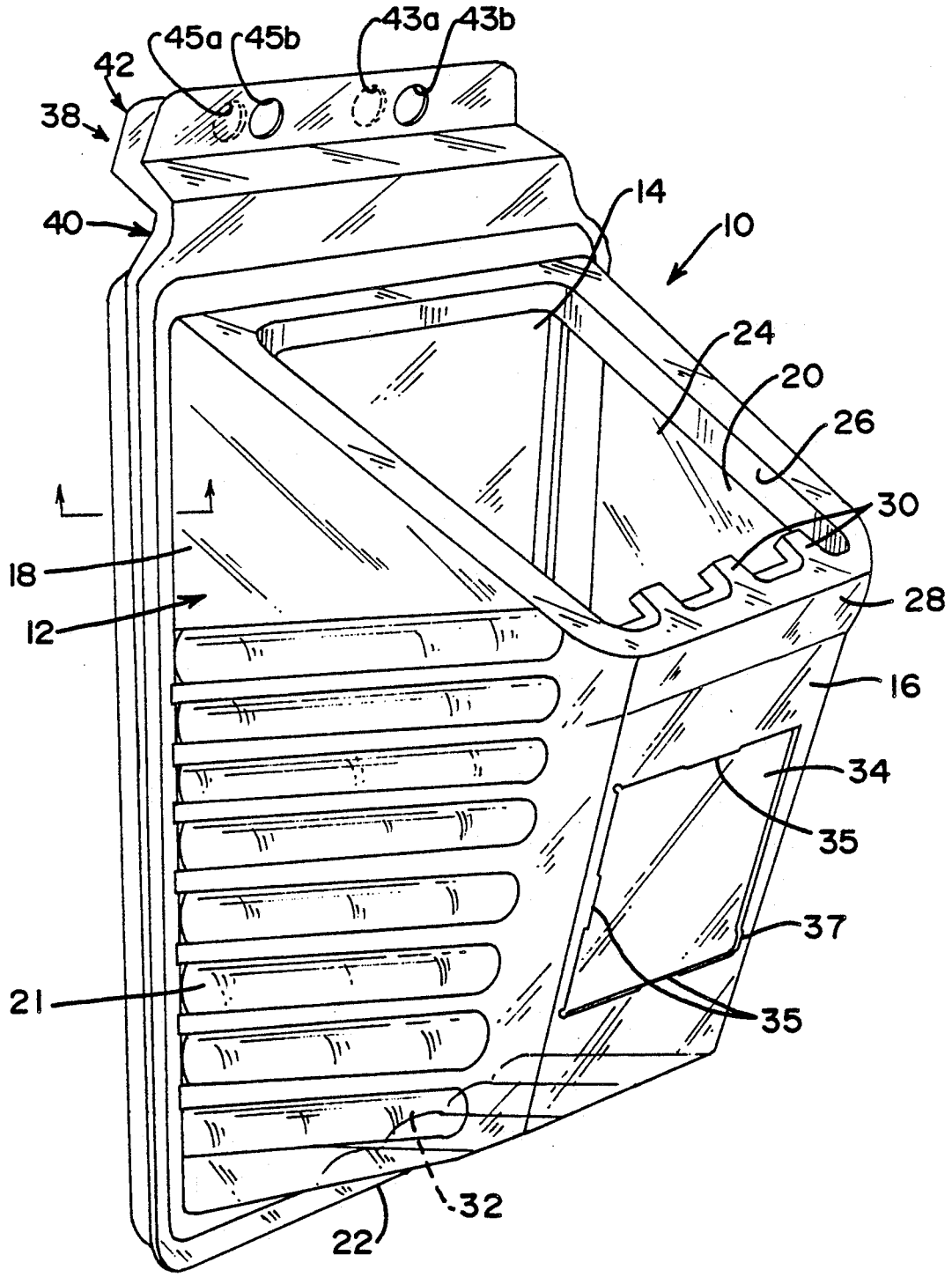
FIG. 1 is a perspective view of a display container according to a first embodiment of the present invention.

Referring to the drawings in detail, and initially to FIGS. 1–5, a display container 10 according to a first embodiment of the present invention includes a receptacle housing 12 having a rear wall 14, front wall 16 and side walls 18 and 20, respectively. As also shown, front wall 16 is downwardly and inwardly inclined, the purpose of which will be described in detail hereinafter. Side walls 18 and 20 are each provided with ribs 21 that provide structural rigidity to container 10. These walls, along with a bottom wall 22 define an enclosure 24 therebetween. As shown, the upper end of receptacle housing 12 has an opening 26 through which elongated articles, such as spatulas, basters, can openers, and the like can be deposited into and removed from enclosure 24.

A rib 28 is formed at the front of opening 26 at the upper end of receptacle housing 12 for providing stiffness thereto so that receptacle housing 12 can carry a plurality of articles without deforming. In addition, the inner front edge of rib 28 includes a plurality of grip-like separators 30, and the upper surface of bottom wall 22 includes a plurality of bump-like separators 32 in alignment with grip-like separators 30. Accordingly, when elongated articles are positioned in receptacle housing 12 so as to rest on bottom wall 22 and extend out of opening 26, such articles are separated into rows by grip-like separates 30 and bump-like separators 32. At such time, the articles lean in rows against front wall 12 because of the downwardly and inwardly extending slope of front wall 12 so as to provide a maximum efficiency of space in receptacle housing 12 and to also impart an appearance that receptacle housing 12 is always full.

Figure 3:
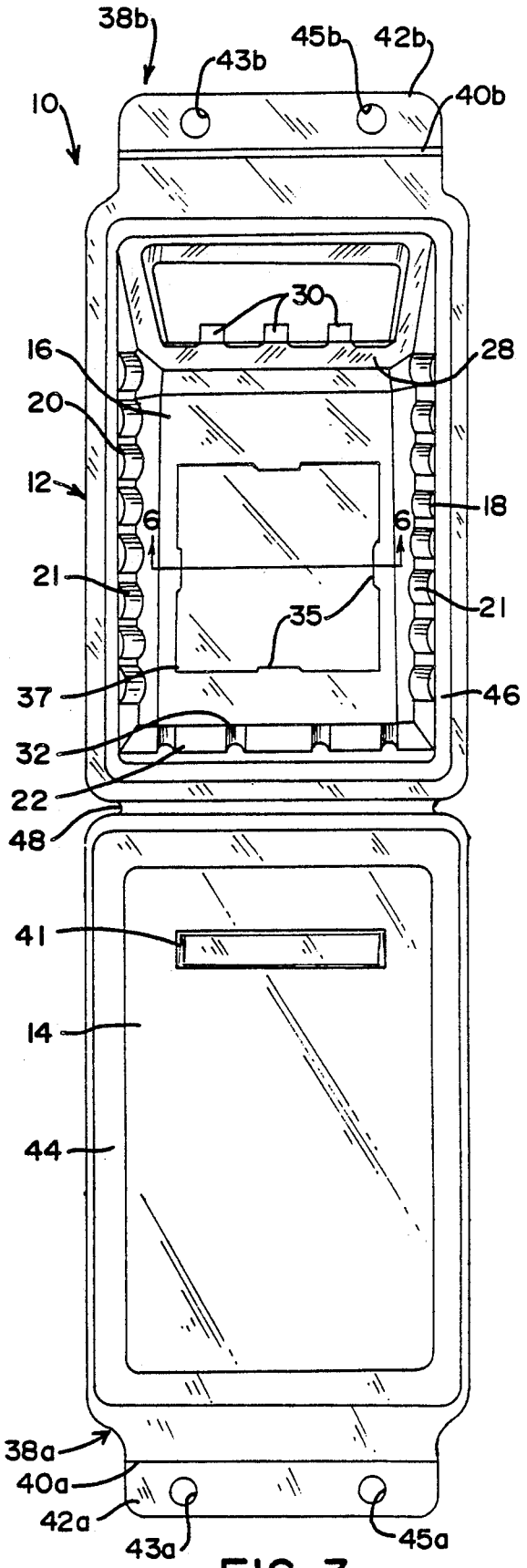
FIG. 3 is a front plan view of the display container of FIG. 1.
Figure 6:
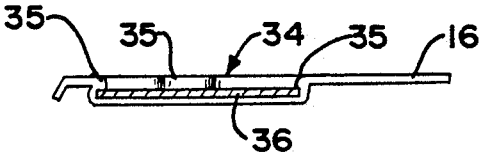
FIG. 6 is a cross sectional view of the display container of FIG. 3, taken along line 5—5 thereof.

The outer surface of front wall 16 is also provided with a pocket 34, having undercut portions 35, as best shown in FIGS. 1, 3 and 6, which are adapted to receive a snap-in label 36 (FIG. 6) having markings thereon which indicate the nature of the articles, the priceand the like. Snap-in label 36 is preferably made of a cardboard type material having a general index weight which can be printed on by means of a printer, as is conventional. In addition, an undercut tab 37 is formed in pocket 34, through which an instrument can be inserted to remove the label 36 from each pocket 34.

In addition, display container 10 includes an L-shaped securing assembly 38 integrally formed at the upper end of rear wall 14 for hanging receptacle housing 12 on a slat board or peg board, as will be described in greater detail hereinafter. In this manner, L-shaped securing assembly 38 includes a horizontal section 40 and a vertical section 42 extending at the free end of horizontal section 40.

Figure 2:
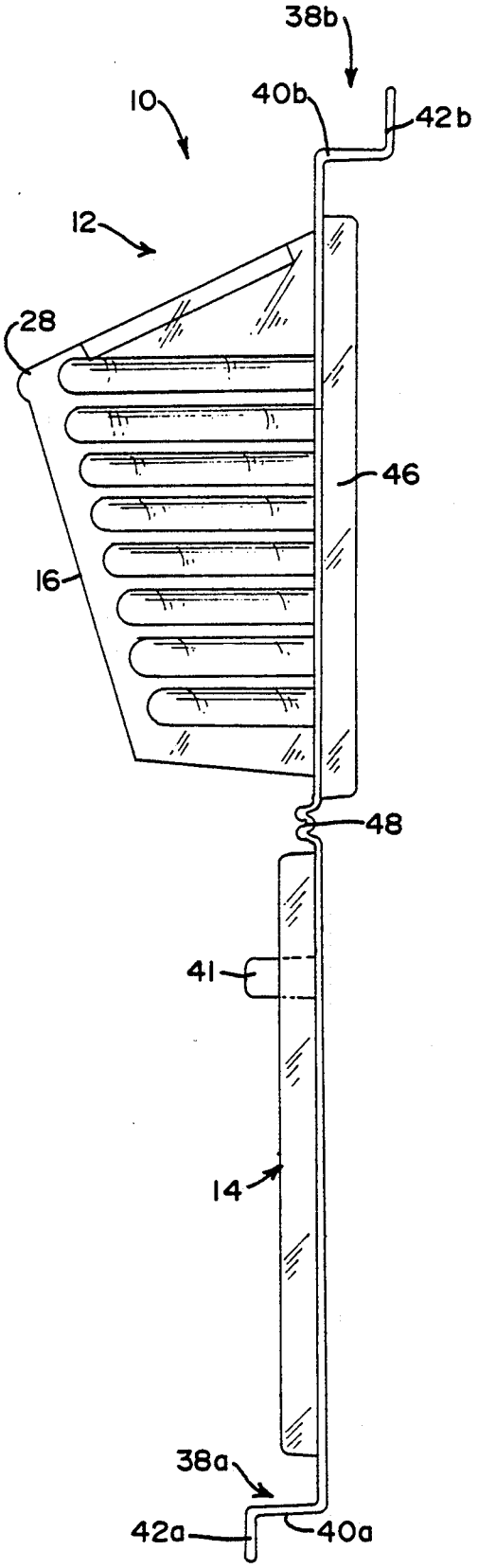
FIG. 2 is side-elevational view showing formation of the display container of FIG. 1 in an unassembled condition.
Figure 15:
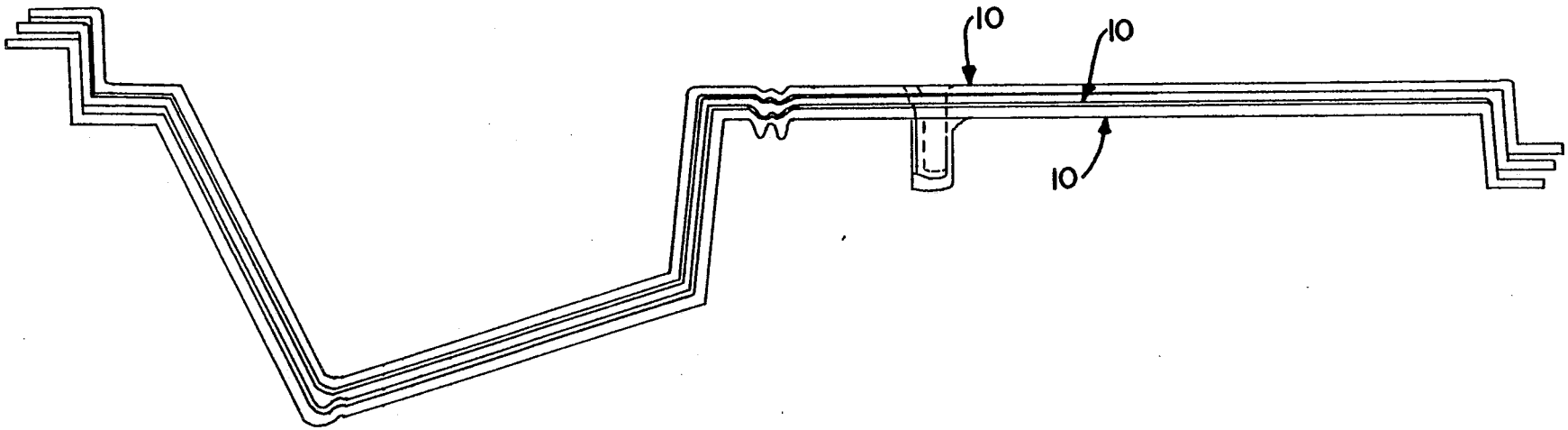
FIG. 15 is a schematic cross-sectional view of a plurality of unassembled containers nested together.

Display container 10 is preferably vacuum formed and in this regard, is generally constructed from a clear plastic film material having a 40 mil thickness. As shown in FIGS. 2 and 3, display container 10 is constructed with rear wall 14 hingedly connected with the remainder of receptacle housing 12 at a hinge 48, which can be easily accomplished in a vacuum forming process. Because of this process, unassembled containers 10 can be nested together, as shown in FIG. 15 for shipping and storage.

Accordingly, rear wall 14 is folded along hinge 48 and assembled with the remainder of receptacle housing 12. In order to secure rear wall 14 to the remainder of receptacle housing 12 in its folded condition, the outer periphery of rear wall 14 is formed with a peripheral grooved lip 44 and the remainder of receptacle housing 12 is formed at the rear wall thereof and peripherally thereabout with a peripheral locking lip 46 which fits together with grooved lip 44 in a friction fit so as to secure rear wall 14 to the remainder of receptacle housing 12, that is, in the configuration shown in FIGS. 1, 4 and 5. In such case, it will be appreciated that L-shaped securing assembly 38 is formed of a first section 38*a* associated with rear wall 14 (and including corresponding horizontal and vertical sections 40*a* and 42*a*) and a second section 38*b* associated with the remainder of receptacle housing 12 (and including corresponding horizontal and vertical sections 40*b* and 42*b*), with first and second sections 38*a* and 38*b* aligning and mating with each other, as shown in FIGS. 1 and 5.

In addition, a locking foot 41 extends transversely at a lower portion of rear wall 14 in the assembled condition of container 10 for use with a slat board, as will be described in greater detail hereinafter.

Further, two holes 43*a* and 45*a* are provided in vertical section 42*a* and two holes 43*b* and 45*b* are provided in vertical section 42*b*, with holes 43*a* and 43*b* being in alignment and holes 45*a* and 45*b* being in alignment in the assembled condition of container 10.

Figure 4:
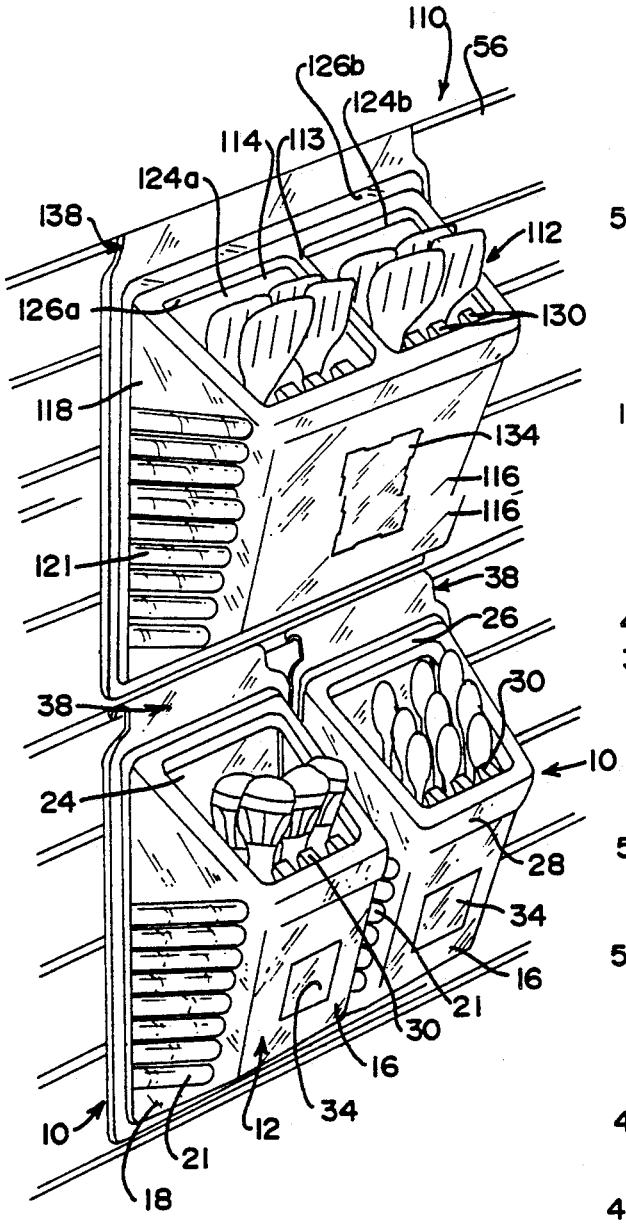
FIG. 4 is a perspective view of two display containers according to FIG. 1 and a display container according to a second embodiment of the present invention, arranged side by side on a vertical slat board.
Figure 5:
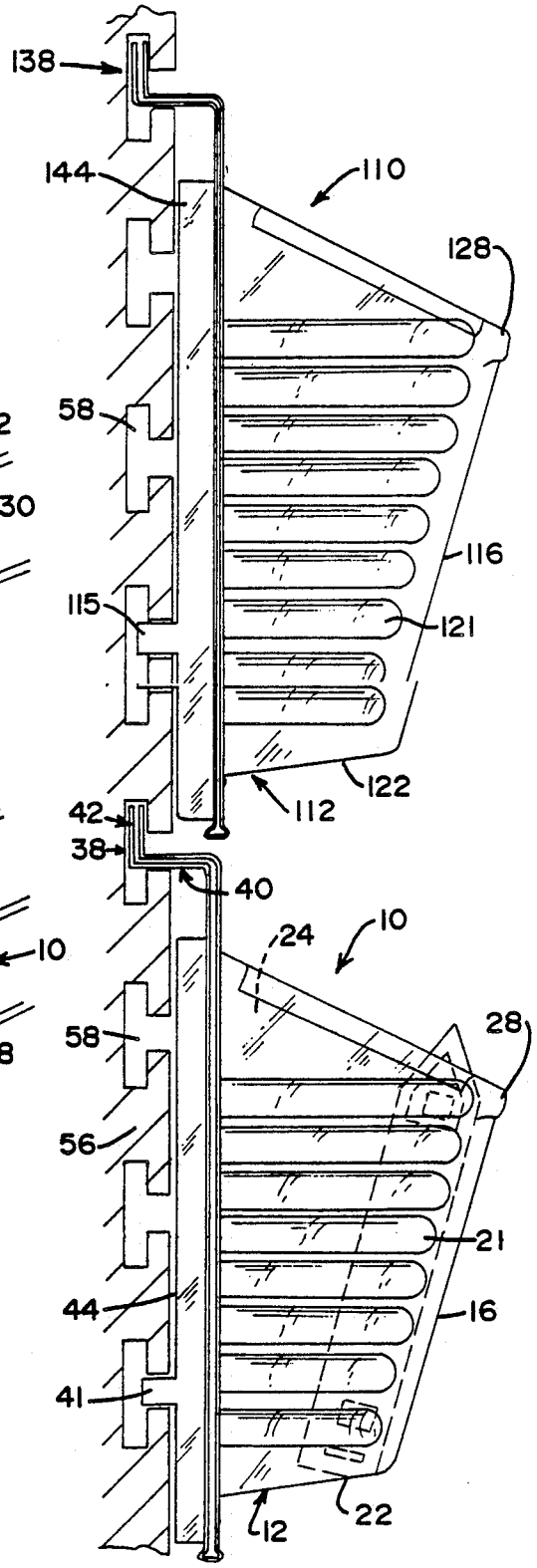
FIG. 5 is a side elevational view of the display containers of FIG. 4.
Figure 11:
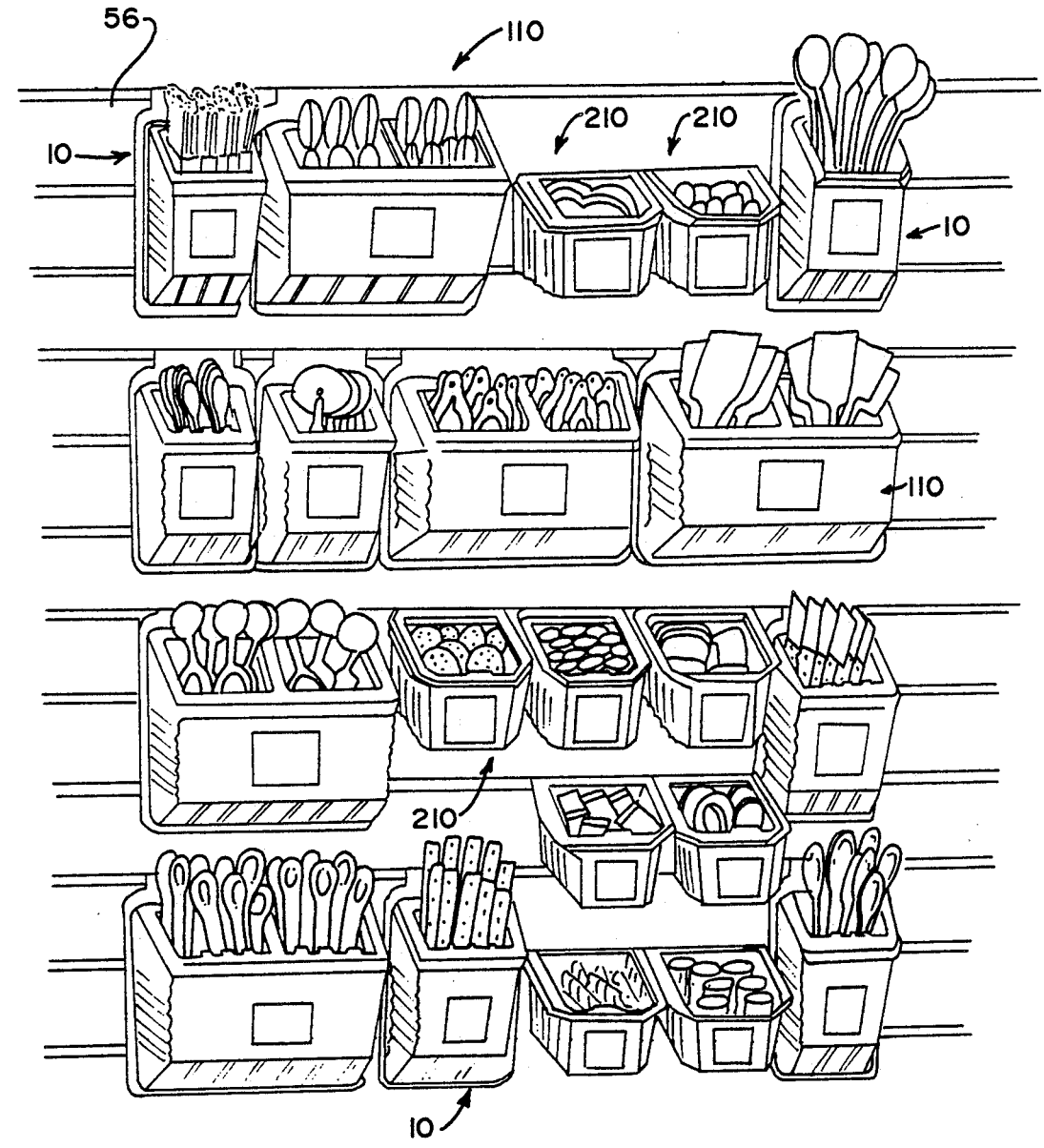
FIG. 11 is a perspective view of a plurality of display containers of FIGS. 1–10 arranged on a vertical slat board.

As shown in FIGS. 4, 5 and 11, a plurality of display containers 10 can be arranged on a vertical slat board 56 having a plurality of T-shaped, horizontally arranged openings 58 which are spaced from each other in the vertical direction, for example, by three inches or any other suitable dimension. As shown best in FIG. 5, L-shaped securing assembly 38 of each display container 10 fits within a T-shaped opening 58 so as to hang and thereby support display container 10 therefrom, with grooved lip 44 of rear wall 14 resting against the outer surface of slat board 56. In such case, because of the downwardly and inwardly extending front wall 14 of each container 10, an elongated article such as a spatula, baster, spoon or the like can be oriented forwardly, as shown best in FIGS. 4 and 5 for sale to the consumer. In addition, because of separators 30 and 32, spatulas, basters and spoons are separated from each other in rows in each display container 10, as shown best in FIG. 4.

Referring now to FIGS. 4, 5, 9 and 11, there is shown a display container 110 according to another emodiment of the present invention in which elements corresponding to those described above with respect to display container 10 will be described by the same reference numerals, augmented by 100, and a detailed description thereof will be omitted herein for the sake of brevity. As shown, each display container 110 includes a larger receptacle housing 112, each receptacle housing 112 being identical to, but having approximately twice the width of, receptacle housing 12 of display container 10 of FIGS. 1–5. Receptacle housing 112 is separated into two adjacent chambers 124*a* and 124*b* by a separating strip 113 which extends across the upper opening from front wall 116 to rear wall 114 to provide two upper openings 126*a* and 126*b*. Because of the larger size of display container 110, it is necessary to further stabilize the same when the latter is secured to a slat board 56, as shown in FIGS. 4 and 5. In this regard, rear wall 114 is formed with two rearwardly extending horizontally oriented locking feet 115, which extend within lower T-shaped openings 58 in slat board 56. In this manner, display container 110 is supported at the upper end thereof by L-shaped securing assembly 38 and at the lower end thereof by locking feet 115.

As with display container 10, display container 110 also preferably has holes similar to holes 43*a*, 43*b*, 45*a* and 45*b* for securing container 110 to a peg board.

Figure 8:
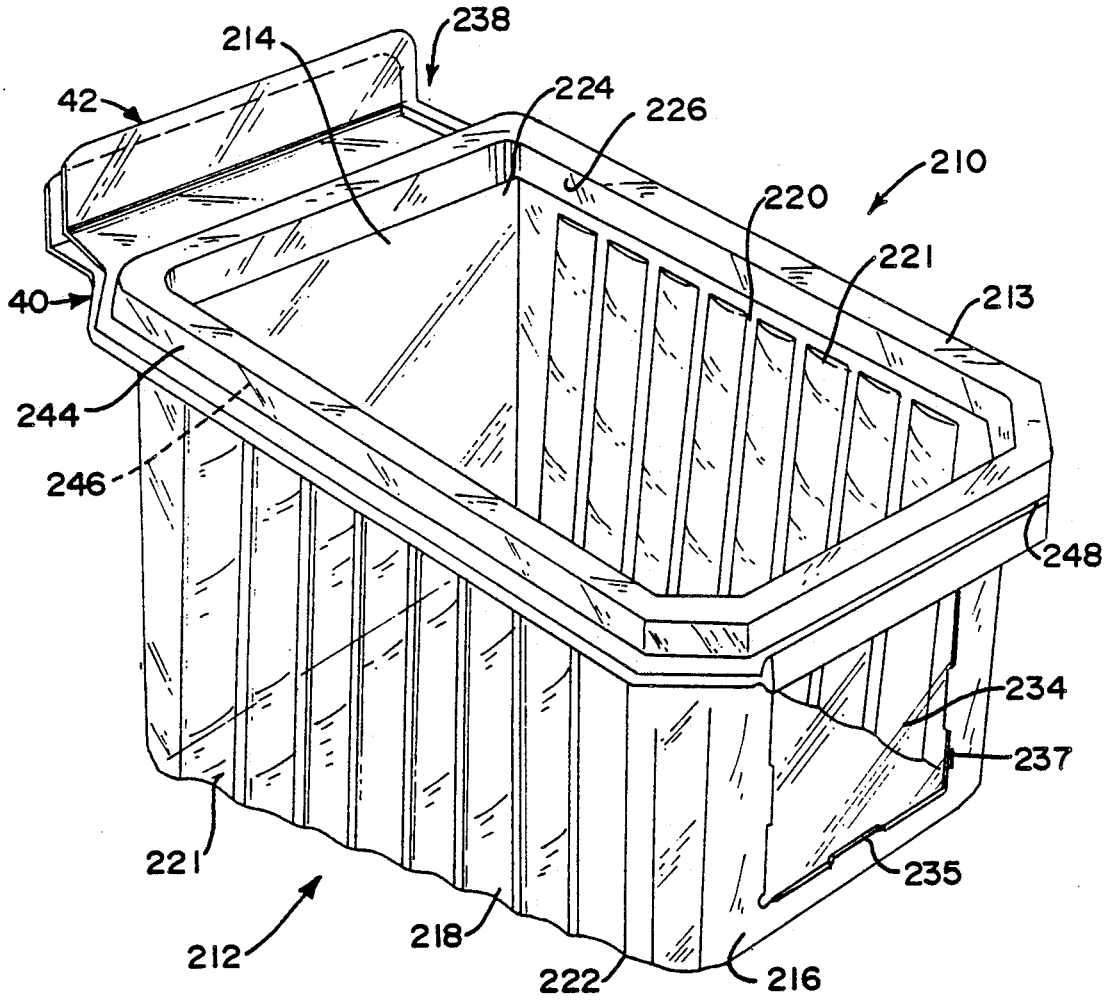
FIG. 8 is a perspective view of a display container according to a third embodiment of the present invention.
Figure 9:
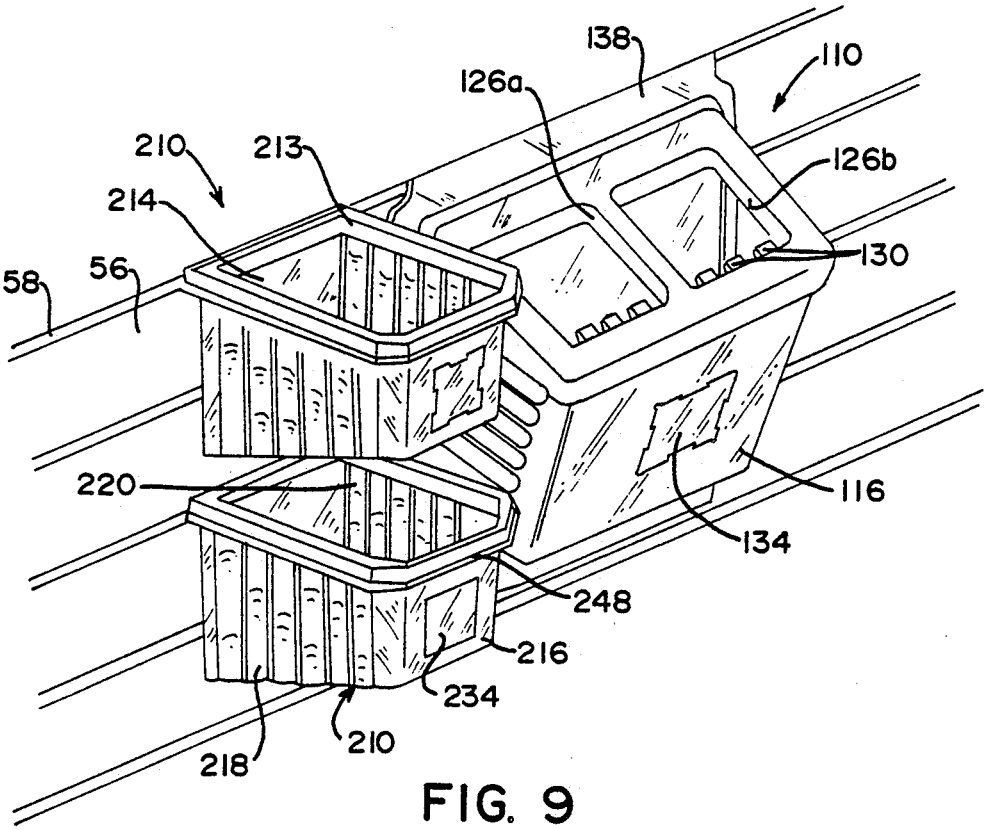
FIG. 9 is a perspective view of two display containers according to FIG. 8 and a display container according to the second embodiment of the present invention, arranged side by side on a vertical slat board.
Figure 10:
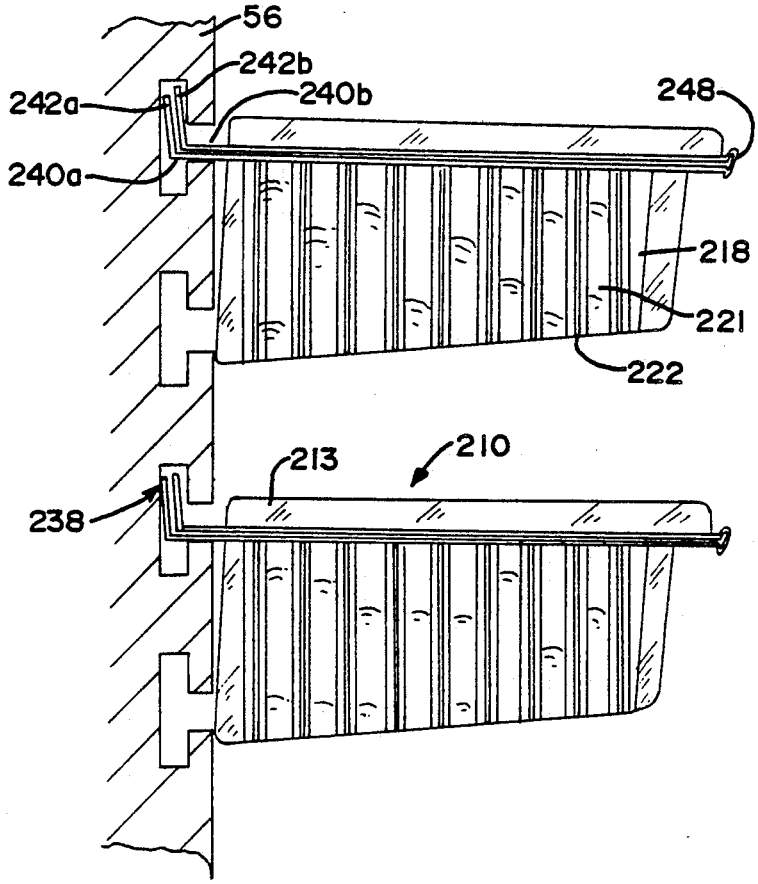
FIG. 10 is a side elevational view of display containers of FIG. 9.

Referring now to FIGS. 8–10, there is shown a display container 210 according to still another embodiment of the present invention, in which elements corresponding to those described above with respect to display container 10 are described by the same reference numerals, augmented by 200, and a detailed description thereof will be omitted herein for the sake of brevity. As shown therein, display container 210 includes a base receptacle housing 212 having a rear wall 214, front wall 216 and side walls 218 and 220, respectively. Side walls 218 and 220 are each provided with ribs 221 to provide structural rigidity to container 210. It will be appreciated that receptacle housing 212 is of a shallower dimension than receptacle housings 12 and 112 and is intended to retain small, loose objects, rather than elongated objects as with display containers 10 and 110. The aforementioned walls, along with a bottom wall 222, define an enclosure 224 therebetween. As shown, the upper end of receptacle housing 212 has an opening 226 through which the articles can be deposited into and removed from enclosure 224.

In addition, display container 210 includes an L-shaped securing assembly 238 integrally formed at the upper end of rear wall 214 for hanging receptacle housing 212 on a slat board as shown in FIGS. 9 and 10. In this manner, L-shaped securing assembly 238 includes a horizontal section 240 and a vertical section 242 extending at the free end of horizontal section 240.

Display container 210 is also preferably vacuum formed in the same manner as display container 10, and in this regard, is generally constructed from a clear plastic film material having a 40 mil thickness. As shown in FIG. 8, display container 210 is constructed with receptacle 212 and a peripheral upper reinforcing wall 213 hingedly connected with receptacle housing 212 at a front hinge point 248. In such case, upper reinforcing wall 213 also has an opening 226. Upper reinforcing wall 213 and the open upper end of receptacle housing 212 are connected together with the aforementioned friction fit of an upper peripheral grooved lip 244 in upper reinforcing section 213 and an upper peripheral locking lip 246 on the upper portion of receptacle housing 212 for forming a friction fit within grooved lip 244.

It will be appreciated that there are no separators 30 and 32 formed with display container 210. This is because a plurality of elongated articles are not deposited therein and need not be aligned in rows.

Further, display container 210 also preferably includes holes (not shown) similar to holes 43*a*, 43*b*, 45*a* and 45*b* for securing container 210 to a pegboard.

FIG. 11 shows an arrangement of a plurality of such display containers 10, 110 and 210 arranged side by side and vertically separated from each other on a slat board 56.

Figure 12:
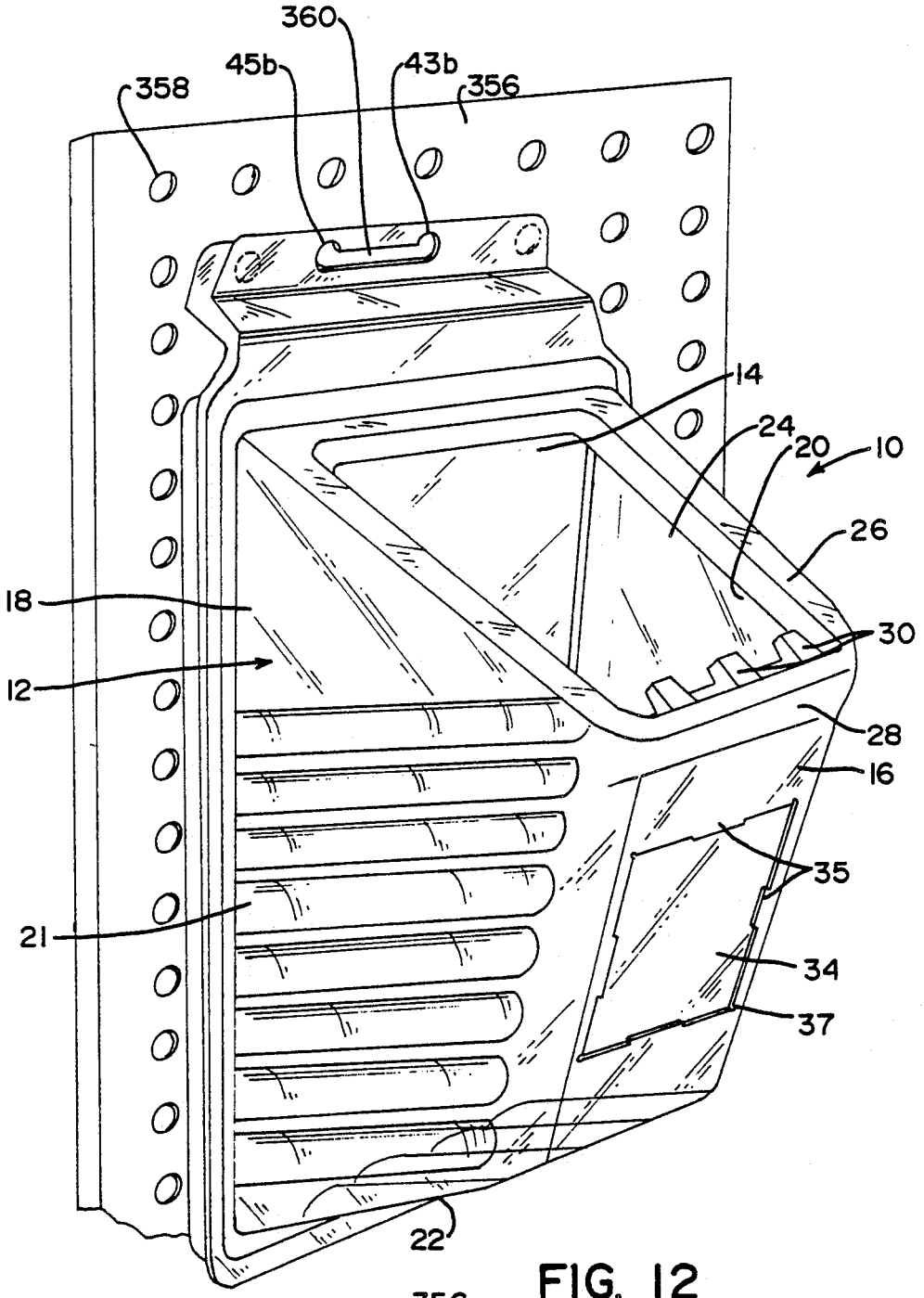
FIG. 12 is a perspective view of a display container according to the first embodiment of the present invention secured to a peg board.
Figure 7:
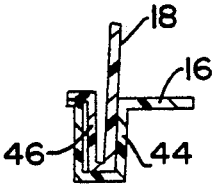
FIG. 7 is a cross sectional view of the display container of FIG. 1 taken along line 7—7 thereof.
Figure 13:
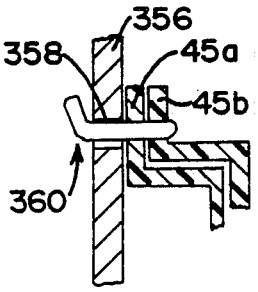
FIG. 13 is a cross-sectional view showing assembly of a portion of the display container of FIG. 12 to a peg board.
Figure 14:
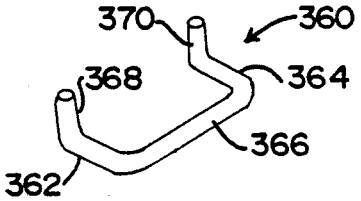
FIG. 14 is a perspective view of the wire hook of FIGS. 12 and 13.

Referring now to FIGS. 12–14, securement of display container 10 according to the present invention to a pegboard 356 will now be described. Specifically, pegboard 356 is provided with a plurality of holes 358 arranged in columns and rows. A U-shaped rigid wire 360 is provided and has two parallel spaced legs 362 and 364 connected at respective ends thereof by a connecting leg 366. The free ends of spaced legs 362 and 364 are upturned at 368 and 370, respectively. In operation, upturned end 368 is extended through hole 45*b*, hole 45*a* and a peg board hole 358 and upturned end 370 is extended through hole 43*b*, hole 43*a* and a spaced pegboard hole 358 until upturned ends 368 and 370 extend behind peg board 356 so as to secure container 10 to pegboard 356 in the manner shown in FIGS. 12 and 13.

Having described specific preferred embodiments of the invention with reference to the accompanying drawings, it will be appreciated that the present invention is not limited to those precise embodiments and that various changes and modifications can be effected therein by one of ordinary skill in the art without departing from the spirit or scope of the invention as defined by the appended claims.

What is claimed is:

1. A display container comprising:

a receptacle housing defining an enclosure therein, said receptacle housing including at least a frontwall, a backwall, and a bottom wall, said receptacle housing including an upper opening through which articles can be deposited into and removed from said enclosure; said bottom wall having a downwardly extending incline from said front wall toward said backwall;

a reinforcing means in surrounding relation to at least a portion of the upper opening; and securing means, connected with said receptacle housing, for securing said receptacle housing an a vertical wall.

2. A display container according to claim 1; wherein said receptacle housing includes opposite side walls connected with said frontwall, said backwall and said bottom wall to define said enclosure.

3. A display container according to claim 2; wherein there is at least one projection extending rearwardly from said rear wall for engagement within an opening in said vertical wall.

4. A display container according to claim 2; wherein said receptacle housing includes rib means along at least a portion of said side walls for imparting stiffness to said receptacle housing.

5. A display container according to claim 1; wherein said reinforcing means includes rib means in surrounding relation to at least a portion of said opening for imparting stiffness to said receptacle housing.

6. A display container according to claim 1; wherein said front wall has an outer surface with an undercut pocket therein for receiving a snap-in label.

7. A display container according to claim 1; wherein said securing means includes L-shaped securing assembly means connected at an upper end of said rear wall for securing said display container to a vertical slat board.

8. A display container according to claim 1; wherein said securing means includes an upper extension of said receptacle housing and at least one aperture for receiving a peg so as to secure said display container to a peg board.

9. A display container according to claim 8, wherein there are two said apertures in said upper extension having a spacing corresponding to a spacing between apertures on the peg board.

10. A display container according to claim 1; further including divider means extending from said front wall to a rear wall of said receptacle housing for dividing said upper opening into two adjacent openings.

11. A display container according to claim 1; further including separator means at a front portion of said upper opening for separating articles deposited in said enclosure.

12. A display container according to claim 11; wherein said separator means includes a plurality of grip-like separators arranged along an inner surface of said receptacle housing at said opening.

13. A display container according to claim 11; further including second separator means on an upper surface of said bottom wall for separating articles deposited in said enclosure.

14. A display container according to claim 13; wherein said second separator means includes a plurality of bump-like separators on said bottom wall in said enclosure.

15. A display container according to claim 13; wherein said first-mentioned separator means and said second separator means are in alignment with each other.

16. A display container of claim 1 wherein said frontwall has a downwardly and inwardly extending incline.

17. A display container of claim 2 wherein said upper opening is formed in a top wall and at least one wall is hingedly connected to said receptacle housing to form a nestable configuration.

18. A display container of claim 17 wherein at least two adjacent walls of said receptacle housing have a downwardly and inwardly extending incline whereby the container is nestable.

19. A display container of claim 17 wherein at least three adjacent walls of said receptacle housing have a downwardly and inwardly extending incline whereby the container is nestable.

20. A display container of claim 17 wherein the top wall is hingedly connected to the receptacle housing.

21. A display container of claim 2 wherein a wall is hingedly connected to the receptacle container whereby the display container is nestable.

22. A display container of claim 21 wherein the backwall is hingedly connected to the receptacle container.

23. A display container of claim 21 wherein at least two adjacent walls of said receptacle housing which are adjacent to said hingeably connected wall have a downwardly and inwardly extending incline toward a wall opposite to said hingedly connected wall.

24. A display container of claim 23 wherein at least three adjacent walls of said receptacle housing which are adjacent said hingeably connected wall have a downwardly and inwardly extending incline toward a wall opposite to said hingedly connected wall.

* * * * *